United States Patent [19]

Sonobe

[11] Patent Number: 4,605,211

[45] Date of Patent: Aug. 12, 1986

[54] AUTOMATIC SHEET PROCESSING DEVICE HAVING TILTABLE COLLECTING TRAY ADJACENT CORNER BINDER STATION

[75] Inventor: Hiraku Sonobe, Yokohama, Japan

[73] Assignee: Canon Kabushiki Kaisha, Tokyo, Japan

[21] Appl. No.: 763,396

[22] Filed: Aug. 7, 1985

Related U.S. Application Data

[63] Continuation-in-part of Ser. No. 628,297, Jul. 6, 1984, abandoned, and Ser. No. 633,271, Jul. 23, 1984, abandoned.

[30] Foreign Application Priority Data

| | | | |
|---|---|---|---|
| Jul. 12, 1983 | [JP] | Japan | 58-126612 |
| Jul. 12, 1983 | [JP] | Japan | 58-126613 |
| Jul. 12, 1983 | [JP] | Japan | 58-126614 |
| Jul. 12, 1983 | [JP] | Japan | 58-126615 |
| Jul. 12, 1983 | [JP] | Japan | 58-126616 |
| Jul. 25, 1983 | [JP] | Japan | 58-135644 |
| Jul. 25, 1983 | [JP] | Japan | 58-135645 |
| Jul. 25, 1983 | [JP] | Japan | 58-135646 |
| Jul. 25, 1983 | [JP] | Japan | 58-135647 |
| Jul. 25, 1983 | [JP] | Japan | 58-135648 |

[51] Int. Cl.[4] ..... B42B 1/02

[52] U.S. Cl. ..... 270/53; 270/58; 271/188; 271/207; 271/213; 227/4; 227/100

[58] Field of Search ..... 270/53, 58; 227/3–7, 227/99–106, 24, 41, 148–154; 395/3 SH; 271/226, 233–239, 248, 250, 253, 188, 207, 209, 213, 221, 146

[56] References Cited

U.S. PATENT DOCUMENTS

| | | | |
|---|---|---|---|
| 734,058 | 7/1903 | Bennett et al. | 271/188 |
| 1,700,681 | 1/1929 | Kelly | 271/213 |
| 2,770,192 | 11/1956 | Mitchell et al. | 271/207 X |
| 3,052,468 | 9/1962 | Cutaia et al. | 271/188 |
| 3,104,101 | 9/1963 | Rabinow et al. | 271/188 X |
| 3,568,578 | 3/1971 | Fujishiro | 271/213 |
| 3,606,312 | 9/1971 | Mens et al. | 271/188 X |
| 3,815,898 | 6/1974 | Haiflley et al. | 271/207 |
| 3,884,408 | 5/1975 | Leiter et al. | 227/100 |
| 3,908,986 | 9/1975 | Bleau | 271/236 |
| 3,994,427 | 11/1976 | Ganatsiou | 227/100 |
| 4,134,672 | 1/1979 | Burlew et al. | 227/99 |
| 4,214,740 | 7/1980 | Acquaviva | 271/188 X |
| 4,238,066 | 12/1980 | Brooke | 270/53 |
| 4,248,413 | 2/1981 | Fox | 270/53 |
| 4,497,478 | 2/1985 | Reschenhofer et al. | 270/53 |

*Primary Examiner*—E. H. Eickholt

*Attorney, Agent, or Firm*—Fitzpatrick, Cella, Harper & Scinto

[57] ABSTRACT

An automatic sheet processing device is adapted to be mounted to the sheet outputting portion of an image forming apparatus which outputs sheets one after another and used to receive the sheets successively output from the sheet outputting apparatus, automatically align the received sheets to one another, and then automatically bind the bundle of aligned sheets.

The automatic sheet processing device comprises a sheet collecting tray rockably supported for receiving sheets output from a sheet outputting apparatus, tray rocking means for selectively changing over the tray to a first posture in which it is capable of receiving the output sheets from the sheet outputting apparatus and a second posture which is more steeply inclined than the first posture and in which it causes the bundle of sheets to be discharged out of the tray, sheet aligning means for aligning the sheets successively discharged into and piled in the tray in the first posture, binding means for binding the bundle of aligned sheets in the tray after a predetermined number of sheets has been output into the tray from the sheet outputting apparatus, and drive means for operating the tray rocking means on the basis of the operation completion signal of the binding means to change over the tray to the second posture.

17 Claims, 27 Drawing Figures

AUTOMATIC SHEET PROCESSING DEVICE HAVING TILTABLE COLLECTING TRAY ADJACENT CORNER BINDER STATION

CROSS-REFERENCE TO RELATED APPLICATIONS

This application is a continuation-in-part of the applicant's co-pending applications Ser. No. 628,297 filed July 6, 1984 and entitled SHEET COLLECTING TRAY DEVICE, now abandoned and Ser. No. 633,271 filed July 23, 1984, now abandoned and entitled AUTOMATIC SHEET PROCESSING DEVICE.

BACKGROUND OF THE INVENTION

1. Field of the Invention

This invention relates to an automatic sheet processing device adapted to be mounted to the sheet outputting portion of an image forming apparatus such as a printing apparatus, a simple printing apparatus or other apparatus which outputs sheets (leaves such as cut sheets, cards and thin boards) one after another and used to receive the sheets successively output from the sheet outputting apparatus, automatically align the received sheets to one another, and then automatically bind the bundle of aligned sheets (by stapling or starching).

2. Description of the Prior Art

Automatic sheet processing devices of this type are effective to rationalize office work, and various devices of such type have already been proposed (for example, in Japanese Laid-open Patent Application No. 99548/1975, Japanese Laid-open Patent Application No. 119047/1978, etc.) and some of them have been put into practical use. Generally, however, these devices according to the prior art are bulky, complicated, expensive ones for use in combination with special, high-class sheet outputting apparatuses of specific types and cannot be used in ready combination with popular copying apparatuses, for example, and thus, they have lacked in versatility.

For example, the device disclosed in Japanese Laid-open Patent Application No. 119047/1978 is of a structure in which the copy finishing device (the sheet processing device) is contained in a copying apparatus. Further, this device is provided with an eccentric pushing device adapted to push the side surface and rear surface of sheets discharged into the tray of the sheet processing device and align the sheets, but is not provided with means for preventing floating up or curling of sheets. Furthermore, in this device, when the document binding operation is completed, the pamphlet is grasped by a jaw actuated by a compressed air cylinder and the pamphlet is discharged from the tray by pivoting of a transfer arm, and this leads to a very much complicated construction.

Also, in the device disclosed in Japanese Laid-open Patent Application No. 99548/1975 (corresponding British Patent No. 1,485,476), the sheet processing device including a staple device is very much complicated. That is, sheets are aligned in the upper tray and fall onto the lower tray, and are stapled in an obliquely standing state. The stapler moves to the bottom of the lower tray in response to the staple signal and binds the sheets. After the binding, the stapler moves along a shaft and opens the bottom of the lower tray. Accordingly, the bound bundle of sheets falls.

On the other hand, there are known several aligning means for aligning sheets in automatic sheet processing devices.

a. Alignment by Vibration

The tray is finely vibrated while sheets are conveyed into the tray and by the vibration, the sheets are moved relative to the two right-angled side plates of the tray as sheet alignment rulers and are aligned with one another.

However, according to this system, the addition of the vibrating mechanism for imparting vibration to the tray leads to the complication, bulkiness and increased cost of the device and it is difficult to set a proper vibration amplitude and frequency. Also, there are numerous problems such as the creation of abnormal sound by the vibration and the adverse effect of the propagation of the vibration to the sheet outputting apparatus side (for example, the reduced quality of the formed image caused by the vibration where the sheet outputting apparatus is an image forming apparatus), and such system is inappropriate as the sheet collecting tray device for an image forming apparatus such as a copying apparatus.

b. Alignment by a Drive Belt

One of the two right-angled side plates of the tray as sheet alignment rulers is made into a rotating belt and one of the two right-angled side edges of sheets is brought into contact with the rotating belt side plate and the sheets are moved toward the other side plate and thereby aligned with one another.

Again in this case, the addition of the rotating belt mechanism leads to the complication, bulkiness and increased cost of the device, and it is difficult to set a proper material for the belt with the friction coefficient thereof taken into account, and the belt is liable to be deteriorated with time.

c. Alignment by a Paddle

A rotatable member (paddle) comprising radially mounted flexible vanes of a frictional material such as rubber sheet pieces is rotated with the vanes brought into contact with the upper surface of sheets discharged into the tray, whereby the sheets are moved toward the two right-angled side plates as sheet alignment rulers and are aligned with one another.

However, again in this case, the addition of the paddle mechanism leads to the complication, bulkiness and increased cost of the device, and sound is created by the vanes striking the upper surface of the sheets.

d. Alignment by an Inclined Tray

A tray is disposed in a posture inclined forwardly upwardly or forwardly downwardly with respect to a sheet discharge port portion for the tray and leftwardly downwardly or rightwardly downwardly with respect to the lateral direction of the tray, and sheets discharged into the tray are caused to slide down from gravity due to the inclined posture of the tray and the two right-angled side edges on the sliding down side of the sheets are stopped by two right-angled side plates as sheet alignment rulers disposed on the sheet sliding-down side of the tray and are thereby aligned with one another.

This aligning system suffices if the tray is disposed in a posture inclined at a suitable angle and therefore, it can constitute a sheet collecting tray device having the sheet aligning function which is simple, noise-free, compact and inexpensive and therefore practical.

The present invention also relates to improvements in the automatic sheet processing device endowed with the sheet aligning function by the inclined tray system mentioned under item d above.

SUMMARY OF THE INVENTION

The present invention has been made in view of the above-noted points and an object thereof is to provide an automatic sheet processing device of the described type which has versatility permitting the device to be widely used in combination with the existing sheet outputting apparatuses of various types and which is high in reliability and compact and low in cost.

It is another object of the present invention to provide an automatic sheet processing device which ensures sheets discharged from a sheet outputting apparatus to be properly aligned on a tray and permits a bundle of sheets bound in a properly aligned state to be automatically bound at a corner thereof.

It is still another object of the present invention to provide an automatic sheet processing device which permits a bundle of sheets bound in a properly aligned state to be automatically discharged.

The present invention has achieved the above-described objects by the following constructions.

That is, an automatic sheet processing, device of the present invention is constructed such that a sheet collecting tray is disposed in a posture inclined forwardly upwardly or forwardly downwardly are rightwardly downwardly or leftwardly downwardly with respect to a sheet discharge port portion, sheet aligning means is provided for stopping the two side edges on the sliding-down side of sheets discharged into said tray and sliding down in said tray due to the inclination of said tray and aligning the sheets with one another and bookbinding means operates at a predetermined point of time after a predetermined number of sheets have been put out from the sheet outputting apparatus into said tray and binding a bundle of aligned sheets in said tray at a corner thereof. This construction leads to the provision of an automatic sheet processing device of this type in which alignment and binding of sheet are ensured and which is high in reliability.

Further, an automatic sheet processing device of the present invention is constructed such that a sheet collecting tray is rockably supported for receiving sheets output from a sheet outputting apparatus, tray rocking means is provided for selectively changing over said tray to a first posture in which it is capable of receiving the output sheets from the sheet outputting apparatus and a second posture which is more steeply inclined than said first posture and in which it causes the bundle of sheets to be discharged out of said tray, sheet aligning means is provided for aligning the sheets successively discharged into and piled in said tray in said first posture, bookbinding means is provided for binding the bundle of aligned sheets in said tray after a predetermined number of sheets has been output into said tray from the sheet outputting apparatus, and drive means is provided for operating said tray rocking means on the basis of the operation completion signal of said bookbinding means to change over said tray to said second posture.

Furthermore, an automatic sheet processing device of the present invention is constructed such that a sheet collecting tray is disposed in a posture inclined forwardly upwardly or forwardly downwardly and rightwardly downwardly or leftwardly downwardly with respect to a sheet discharge port portion for receiving sheets put out from a sheet outputting apparatus, said tray being rockably supported, tray rocking means is provided for selectively changing said tray to a first posture in which it is capable of receiving the output sheets from the sheet outputting apparatus and a second posture more steeply inclined than said first posture, sheet aligning means is provided for stopping the two side edges on the sliding-down side of the sheets successively discharged into said tray in said first posture and piled therein and aligning the sheets with one another, bookbinding means operates at a predetermined point of time after a predetermined number of sheets have been put out from the sheet outputting apparatus into said tray and binding a bundle of aligned sheets in said tray, and said tray is changed over to said second posture by said tray rocking means so that the bound bundle of sheets in said tray is slidingly discharged out of said tray.

These constructions as described above lead to the possibility of providing at a low cost a versatile, practical, automatic sheet processing device of this type which is generally simple in structure, compact and high in reliability.

DESCRIPTION OF THE PREFERRED EMBODIMENTS

Figure 1:
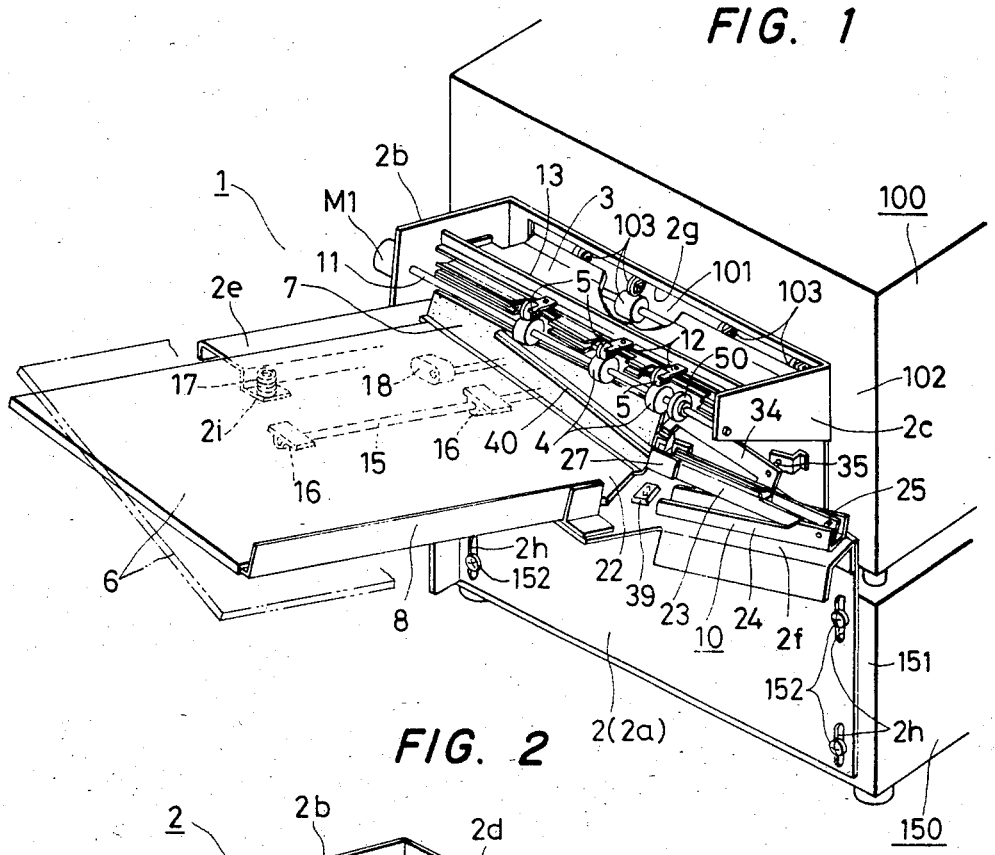
FIG. 1 is a perspective view of a first embodiment of the automatic sheet processing device according to the present invention as mounted to the sheet output port portion of a sheet outputting apparatus.

The invention will hereinafter be described specifically with respect to some embodiments thereof shown in the drawings.

In a first embodiment as illustrated in FIG. 1, reference numeral 1 generally designates an automatic sheet processing device, reference numeral 100 denotes a sheet outputting apparatus, and reference numeral 150 designates a pedestal on which the sheet outputting apparatus is installed. In the present example, it is to be understood that the sheet outputting apparatus 100 is a copying apparatus. Reference numeral 101 designates a sheet output port (sheet discharge port) elongatedly formed in the left end plate 102 of the housing of the copying apparatus, and reference numeral 103 denotes sheet discharging pinch rollers disposed inside and near the sheet output port 101. Copy sheets subjected to the image formation process by an unshown image formation process mechanism contained in the housing of the copying apparatus are discharged by the sheet discharging pinch rollers 103 and are output out of the apparatus through the output port 101.

(1) Outline of the Construction of the Automatic Sheet Processing Device 1

The device 1 according to the present embodiment is designed such that sheet alignment is effected by an inclined tray 6 and first and second sheet aligning ruler plates 7 and 8 disposed at right angles to each other and bookbinding is effected by stapling, and generally comprises the following members and mechanisms assembled to a device chassis 2:

a. a pair of upper and lower sheet guide plates 3 and 3 for receiving sheets P output from the sheet output port 101 of the copying apparatus 100 and guiding them forwardly;

b. sheet discharging pinch rollers 4 and 5 disposed at the fore end portion of the sheet guide plates;

c. a sheet collecting tray 6 disposed in an inclined posture for receiving the sheets discharged from the pinch rollers;

d. first and second sheet aligning ruler plates 7 and 8 disposed at right angles to each other which cooperate with the inclined tray to align the sheets discharged into the tray one after another and piled thereon so that the corresponding right-angled side edges of the sheets are arranged properly;

e. a tray rocking mechanism 9 for rockably supporting the tray and selectively changing over the tray into a first and a second inclined posture;

f. a stapler mechanism 10 for stapling (bookbinding) a bundle of sheets alinged and piled in the tray; and g. an electric circuit, a cable (signal transmitting and receiving line) for connecting the electric circuit to the electric circuit on the copying apparatus 100 side, etc.

Figure 2:
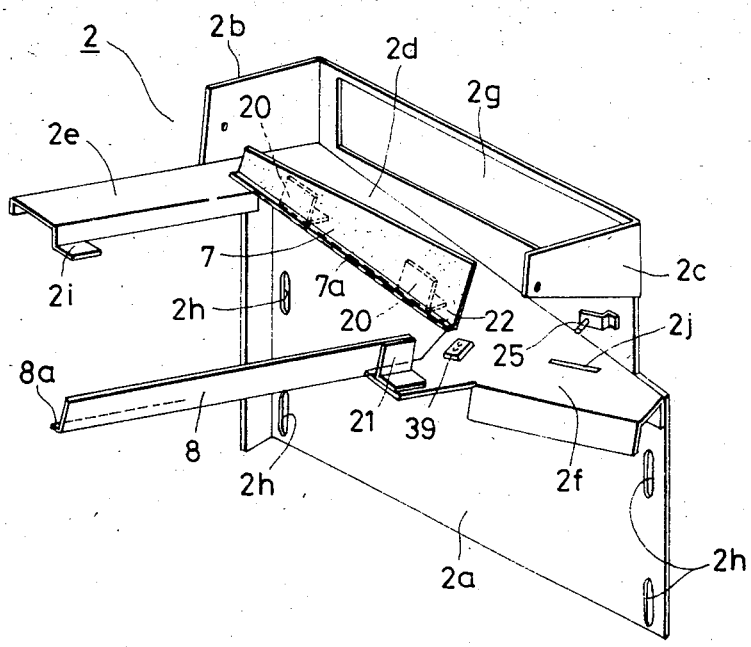
FIG. 2 is a perspective view of the chassis of the device.

(2) Device Chassis 2 (FIG. 2)

The device chassis 2 comprises chiefly a vertical back plate portion 2a of a size extending substantially over both of the left end plate 102 which is the sheet output port side of the copying apparatus 100 and the left end plate 151 of the pedestal 150 on which the copying apparatus is installed, and is provided with left and right side plate portions 2b and 2c projected forwardly on the upper portions of the left and right side edges of the vertical back plate portion 2a, a laterally elongated intermediate ledge plate portion 2d disposed at a position slightly above the intermediate portion of the vertical back plate portion 2a and extending substantially transversely of the back plate from the left side edge to the right side edge of the back plate, a forwardly projecting cross arm portion 2e formed at the left end of and contiguously to the intermediate ledge plate portion, a wide ledge plate portion 2f formed at the right end of and contiguously to the intermediate ledge plate portion, a laterally elongated window hole 2g formed in the portion of the vertical back plate portion 2a which is adjacent to the upper edge thereof, and vertically extending screw receiving slots 2h formed at the four corners of the substantially lower half portion of the vertical back plate portion 2a.

The intermediate ledge plate portion 2d, the cross arm portion 2e contiguous thereto at the left end thereof and the wide ledge plate portion 2f at the right end thereof are generally disposed in a posture forwardly upwardly inclined at an angle $\alpha_1$ with respect to the vertical back plate portion 2a and rightwardly downwardly inclined at an angle $\beta_1$, in the relation with the inclination of the tray which will later be described.

Figure 3:
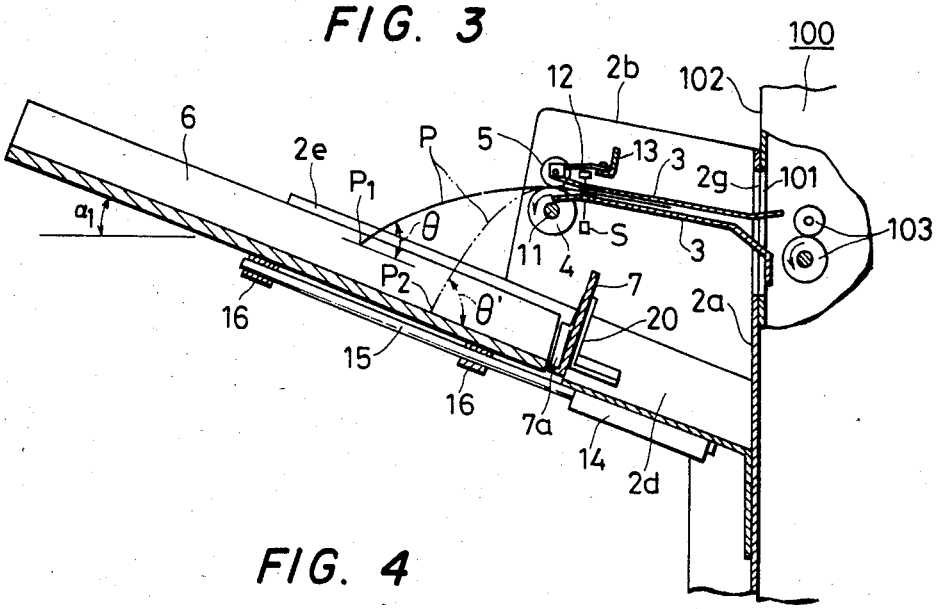
FIG. 3 is a longitudinal cross-sectional view of the device.
Figure 4:
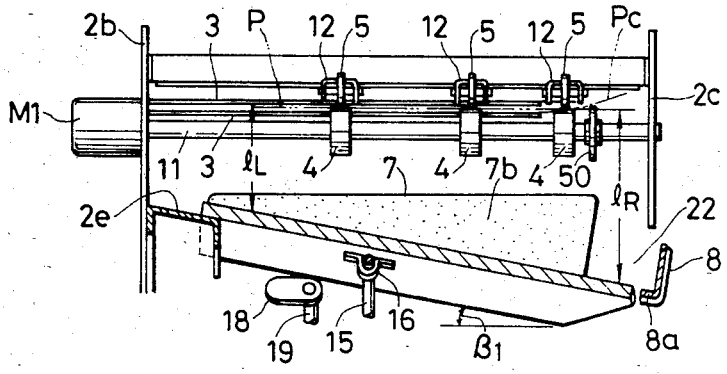
FIG. 4 is a transverse cross-sectional view of the device.
Figure 5:
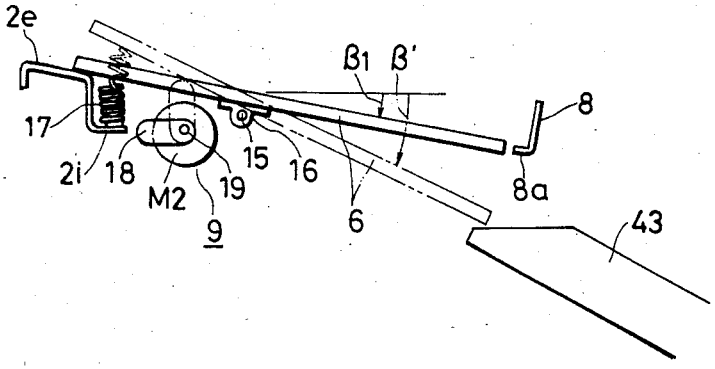
FIG. 5 is a front view of a tray rocking mechanism portion.

(3) Sheet Guide Plates 3, 3 and Sheet Discharging Pinch Rollers 4, 5 (FIGS. 1, 3 and 4).

Sheet guide plates 3 and 3 are for receiving the sheets P output from the sheet output port 101 of the copying apparatus 100 and guiding the leading end edge of the sheets to the nip between the sheet discharging pinch rollers 4 and 5, and are disposed between the left and right side plates 2b and 2c of the chassis with their opposite end portions fixed to the inner sides of the chassis side plates.

The sheet discharging pinch rollers 4 and 5 are disposed adjacent to the fore end edge of the sheet guide plates 3 and 3 and serve to nip the sheets fed through the gap path between the guide plates 3 and 3 and discharge them into the tray 6 which will later be described. In the present embodiment, the lower rollers 4 are drive rollers and the upper rollers 5 are follower rollers, and three such drive rollers 4 are supported on a rotary shaft 11 rotatably journalled to the left and right side plates 2b and 2c of the chassis and rotatively driven by a motor M1 mounted and supported outside the left side plate 2b of the chassis, at predetermined intervals along the length of the rotary shaft. The follower rollers 5 corresponding to the respective drive rollers 4 are rotatably supported on the fore ends of support arms 12 each formed of a spring plate and having the base thereof secured to a stay 13 disposed between the left and right side plates 2b and 2c of the chassis, as by screws, and are normally brought into contact with the upper surface of the drive rollers 4 by the downward biasing force of the spring plate support arms 12.

The path formed by the upper and lower sheet guide plates 3 and 3 may preferably be a small gap path of about 1-2 mm to prevent flapping of the sheets between the two guide plates. Also, the sheet guide plates may preferably be formed with vent holes or be formed or wire-like members, mesh members or the like as long as the sheet conveyance is not hampered, in order to prevent condensation of the water vapor created from the sheets passing between the sheet guide plates and to prevent the hindrance of sheet conveyance by the condensation.

The peripheral speed of rotation of the sheet discharging pinch rollers 4 and 5 is made more or less higher than that of the sheet discharging pinch rollers 103 of the copying apparatus 100 to prevent slack of the sheets between the sheet guide plates 3 and 3, and the nip pressure of the pinch rollers 4 and 5 is set more weakly than that of the pinch rollers 103 of the copying apparatus 100.

The tray 6, as previously described, is forwardly upwardly inclined with respect to the sheet discharge port portion 4, 5 and is also rightwardly downwardly inclined and therefore, the head distance $l_R$ between the right end side of the sheet outlet and the right side edge of the tray is greater than the head distance $l_L$ (FIG. 4) between the left end side of the sheet discharge port portion with respect to the lengthwise direction of the sheet outlet and the left side edge of the tray. Therefore, if the sheet P fed out from the sheet discharge port portion 4, 5 into the tray 6 is weakened in rigidity, for example, under the environment of high temperature and high humidity or the sheet P is originally weak in rigidity, the degree of downward curvature of the portion of the sheet P which has been fed out from the sheet discharge port portion 4, 5 toward the tray 6 by an amount corresponding to a certain length becomes great, and the left corner $P_1$ of the leading end edge of the sheet enters the surface of the tray 6 at an acute angle because the head distance $l_L$ with respect to the tray is relatively small, but the right corner $P_2$ of the leading end edge of the sheet is liable to enter the surface of the tray 6 at an obtuse angle $\theta'$ or at an angle approximate to 90° as indicated by dots-and-dash line in FIG. 3 because the head distance $l_R$ with respect to the tray is great.

In such a case, the leading end portion of the sheet which is in contact with the surface of the tray 6 does not continuedly slide up along the forwardly upwardly inclined surface toward the fore end edge of the tray and as a result, the sheet P is reversed and discharged into the tray 6.

Such reversal discharge trouble of sheets may also occur in a tray device of the type in which the tray 6 is forwardly downwardly inclined.

Therefore, in the device of the present embodiment, to eliminate the sheet reversal discharge trouble resulting from the cause as described above, a member for upwardly warping that side edge portion of the sheet fed out from the sheet outlet of the sheet discharge port portion with respect to the tray toward the tray which corresponds to the laterally inclined lower side of the tray is disposed at the sheet outlet.

Figure 11:
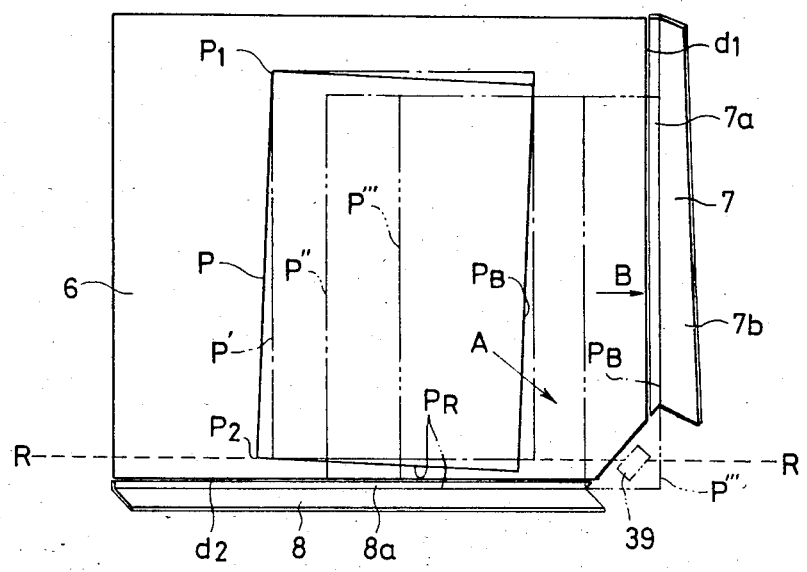
FIG. 11 illustrates the sheet aligning process of the first embodiment.
Figure 12:
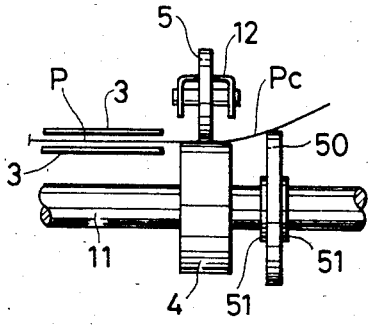
FIG. 12 is a front view of a sheet warping roller portion of the first embodiment.

In FIGS. 1, 4 and 12, reference numeral 50 designates a roller disposed as the sheet warping member. This roller 50 is fitted on the portion of the pinch roller driving shaft 11 between the sheet discharging pinch rollers 4 and 5 which is nearest to the sheet conveyance standard line R—R (FIG. 11) so as to regulate any shift movement along the shaft 11 by snap rings 51 and 51 and to be rotatable about the shaft 11, and the outer diameter thereof is made suitably greater than the outer diameter of the driving roller 4 of the pinch rollers 4 and 5. The roller 50 may be rotatably mounted on the shaft 11 through a bearing.

Thus, that side edge of the sheet P fed out from the sheet outlet of the sheet discharge port portion to the tray 6 which corresponds to the laterally inclined lower side of the tray, in the present example, the right side edge of the sheet, passes over the roller 50 correspondingly to the roller 50. Since, as described above, the diameter of the roller 50 is suitably greater than the diameter of the driving roller 4 of the sheet discharging pinch rollers, the right side edge of the sheet P passes over the roller 50 while being upwardly warped as indicated at Pc in FIGS. 4 and 12 against the resiliency in the range of resiliency of the sheet due to the diameter difference in the process wherein it passes over the roller 50. On the basis of the riblike effect of the upward warp Pc of the sheet over the roller 50, even if the sheet P is weakened in rigidity by moisture absorption or the like or the sheet P is originally weak in rigidity, the great downward curvature of that portion of the sheet which has been fed out from the sheet outlet toward the tray 6 by an amount corresponding to a certain length is alleviated and the angle of entry $\theta$ of the sheet with respect to the surface of the tray 6 is secured at an acute angle over the full length of the leading end edge of the sheet, whereby the aforementioned sheet reversal discharge trouble can be eliminated. Here, it should be noted that such a device for eliminating the sheet reversal discharge trouble may be optionally employed in the automatic sheet processing device.

(4) Sheet Collecting Tray 6 and its Rocking Mechanism 9 (FIGS. 1 and 3-5)

The tray 6 has its back side supported for leftward and rightward rocking movement about a shaft bar 15 through bearing members 16 and 16, the shaft bar 15 having its base firmly held by a fixing support member 14 at a position slightly more toward the left end than the intermediate position of the intermediate ledge plate portion 2d of the chassis on the back side of the ledge plate and forwardly upwardly inclined at an angle $\alpha_1$. Thus, the tray 6 is normally subjected to the tension of a tension spring 17 (FIGS. 1 and 5) extended between a lug 2i formed on the cross arm 2e of the chassis and the back side near the left side edge of the tray 6 and is biased counterclockwise about the shaft bar 15, and is normally stopped with the back side of the left side edge of the tray finally bearing against the upper surface of the cross arm 2e of the chassis and is held in a posture forwardly upwardly inclined at an angle $\alpha_1$ and rightwardly downwardly inclined at an angle $\beta_1$. This posture will hereinafter referred to as the first posture. The angle of forwardly upward inclination $\alpha_1$ and the angle of rightwardly downward inclination $\beta_1$ in the first posture of the tray 6 are set, for example, to the ranges of 23°-26° and 6°-10°, respectively.

Reference numeral 18 designates a tray rocking cam. This cam is secured at a right angle to the fore end of the forwardly projecting rotary shaft 19 of a reversible pulse motor M2 fixedly disposed on the back side of the intermediate ledge plate portion *2d* of the chassis at a position near the left end of this ledge plate, and is changed over from its leftward sideways facing posture indicated by solid in FIG. 5 to its upwardly rotated posture indicated by dots-and dash line in FIG. 5 by the forward revolution or reverse revolution control of the motor M2 by about 90°, and is again returned to its sideways facing posture. When this cam 18 is in its sideways facing posture, it is not in contact with the tray 6 and the tray 6 is kept in said first posture, but when the cam 18 is changed over to its upwardly rotated posture by the forward revolution driving of the motor M2 by about 90°, the tip end of the cam comes into contact with the back side of the left corner of the rear end edge of the tray and pushes it in a push-up direction, so that the tray 6 is pivoted clockwise about the shaft bar 15 against the force of the tension spring 17 and is changed over to and held in a posture indicated by dots-and-dash line in FIG. 5 in which it is rightwardly downwardly inclined at an angle $\beta'$ greater than the angle of rightwardly downward inclination in the first posture. This posture will hereinafter be referred to as the second posture. When the cam 18 in this upwardly facing posture is again changed over to its sideways facing posture by the reverse revolution driving of the motor M2 by about 90°, the tray in the second posture returns to the first posture.

The tray rocking mechanism 9, in the present embodiment, refers to the entire mechanism comprising the tray supporting shaft bar 15, the tension spring 17, the cam 18, the motor M2, etc.

(5) Sheet Aligning Ruler Plates 7, 8 (FIGS. 1–6 and 11)

The sheet aligning ruler plates 7 and 8 are members for stopping the two right-angled side edges of the sliding-down side of sheets discharged into the tray 6 in the first posture and sliding down in the tray due to the inclination of the tray, namely, in the present example, the trailing end edge $P_B$ (FIG. 11) and the right side edge $P_R$ of the sheets, and aligning the sheets discharged one after another into the tray and piled therein. It is to be understood that the ruler plate 7 for stopping the trailing end edge $P_B$ of the sheets is a first sheet aligning ruler plate and the ruler plate 8 for stopping the right side edge $P_R$ of the sheets is a second sheet aligning ruler plate.

The first ruler plate 7 is mounted and supported along the fore end edge of the intermediate ledge plate portion *2d* of the chassis through a bracket 20 (FIGS. 2 and 3), and the second ruler plate 8 has its rear end portion firmly mounted and supported on the fore end portion of the wide ledge plate portion *2f* of the chassis in a cantilever fashion through a bracket 21. The two ruler plates 7 and 8 are at right angles to each other. The right corner of the rear end edge of the tray 6 is obliquely chamfered (FIGS. 1 and 11), and the right end of the first ruler plate 7 and the rear end of the second ruler plate 8 only extend to the position corresponding to the chamfered portion of the tray and do not meet each other, and that portion provides an opening portion 22.

Figure 6B:
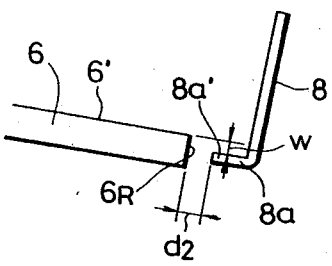
FIGS. 6A and 6B are cross-sectional views of first and second sheet aligning ruler plates, respectively.
Figure 6A:
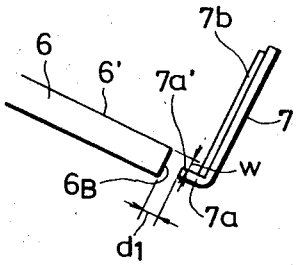
Figure 9:
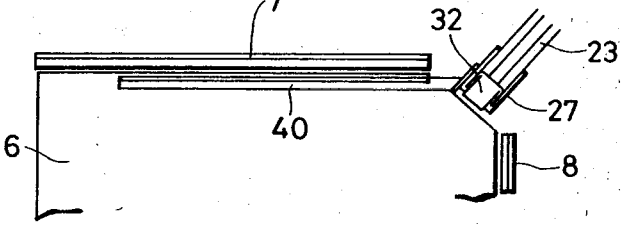
FIG. 9 is a plan view of a paper keeping member.
Figure 10:
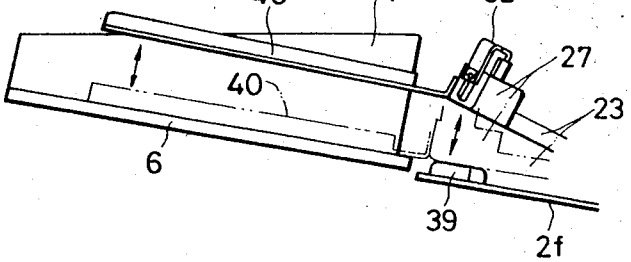
FIG. 10 is a front view of the paper keeping member.

Both of the first and second ruler plates 7 and 8 have their lower edge portions inwardly bent at a right angle to form narrow overhanging edges *7a* and *8a*. Thus, in the first posture, the tray 6 is positioned so that as shown in FIGS. 6A and 6B, the rear end edge $6_B$ thereof corresponds to the lower narrow overhanging edge *7a* of the first ruler plate 7 through a slight gap d1 and the right side edge $6_R$ thereof corresponds to the lower narrow overhanging edge *8a* of the second ruler plate 8 through a slight gap d2 which permits pivoting of the tray. Also, the first and second ruler plates 7 and 8 are constructed in such a relation that a step W is created so that the upper surfaces *7a'* and *8a'* of the lower narrow overhanging edges *7a* and *8a* of the first and second ruler plates 7 and 8 underly the upper surface 6' of the tray 6 at this time.

Therefore, the stagnation of the sheet in the course of its sliding down along the tray caused by the edge of the sheet entering the boundary gap d2 or d1 between the tray and the ruler plates before the right side edge $P_R$ or the trailing end edge $P_B$ of the sheet discharged into the tray and having slidden down along the surface of the tray (the first discharged sheet) bears against the inner surfaces of the second and first alinging ruler plates 8 and 7 is prevented and alignment of sheets is ensured.

(6) Stapler Mechanism 10 (FIGS. 1 and 7–10)

The stapler mechanism 10 comprises a stapler body 23 provided above the wide ledge plate portion *2f* of the chassis and a driving mechanism portion assembled to the lower side of the same ledge plate portion *2f*.

The stapler body 23 is connected to the rear end portion of a channel type guide member 24 for vertical rocking movement about a shaft 25, the guide member 24 being fixedly positioned with its lengthwise axis extending on the upper surface of the wide ledge plate portion *2f* of the chassis toward the opening portion 22 between the first and second ruler plates 7 and 8, and is normally biased upwardly relative to the guide member 24 by a torsion spring 26 fitted to the shaft 25 and stretched between the guide member 24 and the stapler body 23.

The stapler body 23 comprises a box-shaped head portion 27 provided at the fore end portion thereof and having its upper surface opened, a staple needle loading guide groove portion 28, a needle pushing member 30 for normally pushing the rear end of a series of staple needles 29 loaded into the groove portion 28 to thereby press the fore end of the staple needles 29 against the outer surface of the opposed side wall *27a* of the head portion 27, a spiral spring biasing the needle pushing member 30 and having one end thereof restrained by the stapler body, a downwardly facing, substantially U-shaped staple needle striking member 32 put on the head portion 27 and slidable up and down relative to the head portion 27, and a coil spring 33 compressedly disposed between the head portion 27 and the striking member 32.

The striking member 32 is formed by bending a band plate into a U-shape and is inverted and put on the head portion 27 so as to hold the staple needle stopping side wall *27a* of the head portion 27 and the front wall 27 of the head opposite thereto between its downwardly facing leg plates *32a* and *32b*. The front wall *27b* of the head is formed with a longitudinally extending slit hole *27c* as shown in the enlarged views of FIGS. 8A–8C, and at a position near the lower side of the downwardly facing leg plate *32b* of the striking member which corresponds to the front wall *27b* of the head, an obliquely upwardly extending pawl *32c* projecting toward the inside of the leg plate is formed and fitted in the slit hole *27c* of the head portion 27. Also, side walls *32d* and *32e* are regulated by *27e* and *27f* and therefore, there is no lateral shift movement and these side walls are slidable up and down relative to the head portion 27 and the pawl 32*c* is normally stopped by bearing against the upper edge of the slit hole 27*c* due to the pushing-up force of the compressed coil spring 33 and is held in an upwardly raised position relative to the head portion 27 until it is stopped in the upwardly raised position relative to the head portion 27.

The spring pressure F26 of the torsion spring which biases the stapler body 23 so as to open and rotate about the shaft 25 relative to the guide member 24 and the spring pressure F33 of the coil spring 33 compressedly disposed between the head portion 27 and the striking member 32 are set to a relation that F26<<F33.

Reference numeral 34 designates an L-shaped stapler body pushing-down lever having a sideways facing arm 34*a* and a downwardly facing arm 34*b* and pivotable about a shaft 35. A lug 34*c* adapted to bear against the upper surface of the striking member 32 of the stapler body is laterally formed at the fore end portion of the sideways facing arm 34*a*, and the lower side of the downwardly facing arm 34*b* projects from a slit hole 2*j* (FIG. 2) formed in the surface of the wide ledge portion 2*f* of the chassis toward the portion below the ledge portion 2*f*.

M3 designates a stapler driving reversible motor mounted on the surface of the vertical back plate 2*a* of the chassis, reference numeral 37 denotes a pivotable arm having its base secured to the rotary shaft 36 of the motor M3, reference numeral 38 designates a cam plate also secured to the shaft 36, and MS1 and MS2 denote first and second microswitches adapted to be closed and opened with rotation of the cam plate 38. The pivotable arm 37 is formed with a slot 37*a* extending along the length thereof, and a pin shaft 34*d* studded in the lower end portion of the downwardly facing arm 34*b* of the L-shaped lever 34 is fitted in the slot 37*a* to thereby interconnect the pivotable arm 37 and the L-shaped lever 34.

Figure 7:
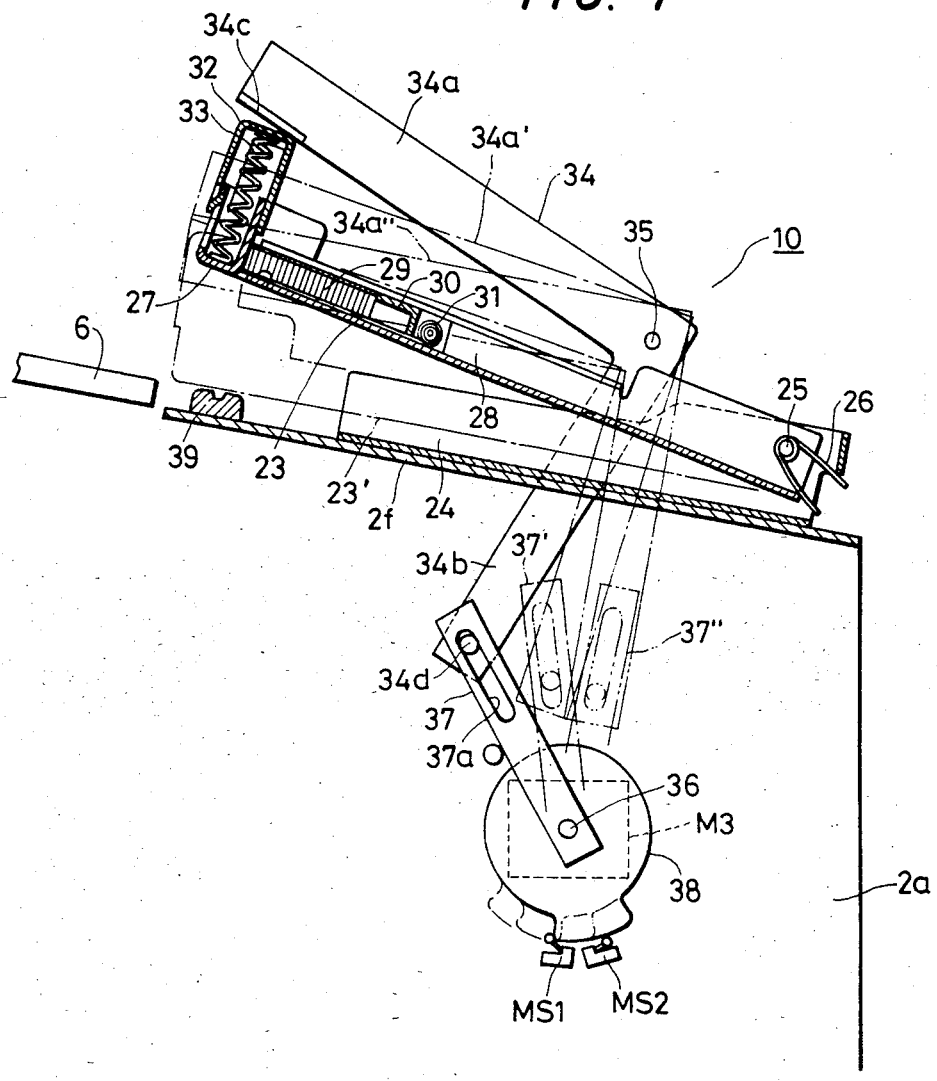
FIG. 7 is a longitudinal cross-sectional side view of a stapler mechanism portion.

The pivotable arm 37 normally stands by at its leftwardly obliquely upwardly rotated angular position as indicated by solid line in FIG. 7. During this condition, the first microswitch MS1 is held in its OFF position by the cam plate 38 and the second microswitch MS2 is held in its ON position, and the L-shaped lever 34 is pivoted clockwise about the shaft 35 and the sideways facing arm 34*a* thereof is held in its leftwardly obliquely upwardly rotated angular position. The stapler body 23 is held in a state in which it has been opened and rotated about the shaft 25 relative to the guide member 24 by the opening-rotating force of the torsion spring 26 until the upper surface of the striking member 32 bears against the lower surface of the lug 34*c* of the sideways facing arm 34*a* and is stopped thereby. The above-described state will hereinafter be referred to as the stapler stand-by state.

The sheets successively discharged from the copying apparatus 150 into the tray 6 of the automatic sheet processing device 1 have the passage of their trailing end edge through the output port 101 of the copying apparatus or through the sheet discharge port portion 4, 5 of the automatic sheet processing device detected by a sheet sensor S (FIG. 3) and, with the detection signal as the starting point, the forward revolution driving of the motor M3 is started by the control circuit after the lapse of a predetermined delay time T required for the copy sheet discharged into the tray 6 to be completely aligned in the tray. By this forward revolution driving of the motor M3, the pivotable arm 37 and the cam plate 38 are rotatively driven clockwise as viewed in FIG. 7. Along therewith, the L-shaped lever 34 also is rotatively driven counterclockwise about the shaft 35 against the force of the torsion spring 26 while depressing the stapler body 23. The first microswitch MS1 is held in its ON position by the starting of the rotation of the cam plate 38. The second microswitch MS2 remains in its ON position for a little while thereafter, and assumes its OFF position when the pivotable arm 37 has come to its nearly vertical rotated angular position 37′ indicated by dot-and-dash line. At this time, the stapler body 23 is depressed and rotated by the L-shaped lever 34 to a position in which the underside of the head portion 27 thereof bears against a staple needle receiving seat 39 disposed in place on the upper surface of the wide ledge portion 2*f* of the chassis (the position indicated by dot-and-dash line 23′ in FIG. 7). During this state, the striking member 32 is still raised by the coil spring 33 and does not yet come to act on the foremost one of the staple needles 29 loaded into the stapler body 23. This depressed state of the stapler will hereinafter be referred to as the first stage depression.

The motor M3 is changed over to the reverse revolution at a point of time whereat the second microswitch MS2 has assumed its OFF position, and the pivotable arm 37 pivots back counterclockwise until the first microswitch MS1 assumes its OFF position again, and thus the stapler returns to its initial stand-by condition. The first stage depression and return to the stand-by condition of the stapler are repeatedly executed each time a copy sheet is output or discharged from the copying apparatus 100 into the tray 6.

By the repetition of the first stage depression and return of the stapler, each time a copy sheet is discharged from the copying apparatus 100 into the tray 6 and comes to its aligned position, the right corner of the trailing end edge of the sheet projecting from the opening portion 22 between the first and second ruler plates 7 and 8 toward the wide ledge plate 2*f* of the chassis and positioned on the staple needle receiving seat 39 is held between the needle receiving seat 39 and the underside of the head portion 27 of the first-stage-depressed stapler body 23, whereby mutual alignment of sheets is improved.

Reference numeral 40 (FIGS. 1, 9 and 10) designates a paper keeping bar-like member which may preferably be made of a resilient flexible material and which has its base attached to the side surface of the head portion 27 of the stapler body 23 and which is disposed substantially parallel to the inner surface of the first sheet aligning ruler plate 7. This paper keeping member 40 moves up and down with the up and down movement of the head portion 27 during the first stage depression and return cycle of the stapler and keeps the upper surface of the trailing end portion of the aligned sheets in the tray, and the paper keeping range is widened by the presence of this paper keeping member 40 and even in a case where sheets are curled, the curl of the sheets are corrected by the paper keeping member, whereby mutual alignment of the sheets is further improved.

As regards the sheet keeping by the downward movement of the paper keeping member 40, the alignment of the sheet relative to the second ruler plate 8 is further improved by adopting such as angled posture that the fore end of the paper keeping member 40 first comes into contact with the surface of the sheet, and then the side surface of the base thereof progressively comes into contact with the surface of the sheet with the subsequent downward movement of the member 40 and finally the underside of the member 40 generally comes into contact with the surface of the sheet and keeps down the sheet. The reason for this is that the member 40 presses the sheet toward the ruler plate 8.

Figure 8C:
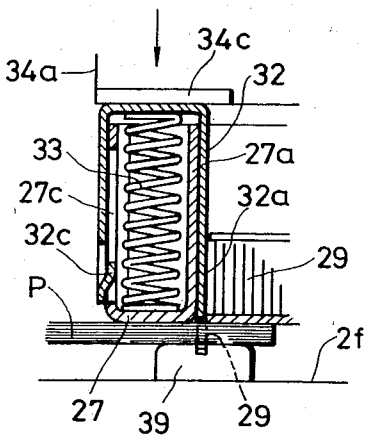
FIG. 8C is a longitudinal cross-sectional side view of the stapler head portion when a needle is depressed.
Figure 8B:
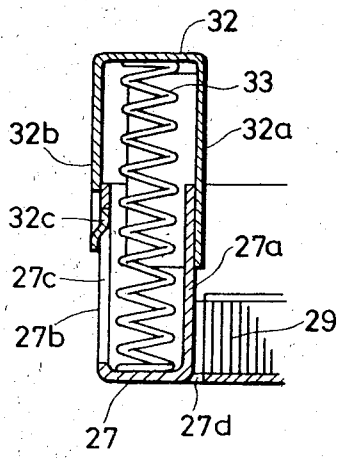
FIGS. 8A and 8B are a front view and a longitudinal cross-sectional side view, respectively of a stapler head portion
Figure 8A:
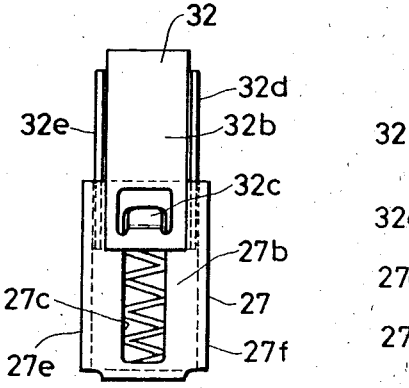

When the successive discharging of copy sheets from the copying apparatus 100 into the tray 6 progresses and the last copy sheet is output, a condition signal indicative of the fact that that copy sheet is the last one is input from the control circuit (not shown) of the copying apparatus 100 to the control circuit (not shown) of the automatic sheet processing device 1. After the lapse of a predetermined delay time T after the passage of the trailing end edge of the last copy sheet has been detected by a sensor S (FIG. 3), the forward revolution driving of the motor M3 is started as in the case of the preceding sheets and the depressing operation of the stapler body 23 is effected. In this case, however, even after the stapler assumes the first stage depression state on the basis of the inputting of the aforementioned condition signal and the second microswitch MS2 assumes its OFF position, the pivotable arm 37 is a little more pivoted clockwise than during the first stage depression in spite of the OFF position of the microswitch MS2 and assumes a substantially vertical rotation angular position indicated by dots-and-dash line in FIG. 7, and the forward revolution driving of the motor M3 is continued until the first microswitch MS1 also assumes its OFF position. In the counterclockwise rotation process of the L-shaped lever 34 resulting from the forward revolution driving of the motor M3 following the first stage depression of the stapler, the striking member 32 of the stapler body 23 is sufficiently depressed relative to the head portion 27 against the force of the coil spring 33 (FIG. 8C). By this depression of the striking member 32, the foremost one of the staple needles 29 loaded into the stapler body 23 is pushed out from a needle push-out gap opening 27*d* toward the needle receiving seat 39 by the lower edge of the downwardly facing leg plate 32*a* of the striking member 32, whereby the bundle of sheets held between the underside of the head portion 27 and the needle receiving seat 39 is staple-processed. The above-described depressed state of the striking member will hereinafter be referred to as the second stage depression of the stapler.

At a point of time whereat the second stage depression of the stapler has been effected and the first microswitch MS1 has assumed its OFF position, the motor M3 is changed over to the reverse revolution and the stapler returns to the initial stand-by condition (the condition indicated by solid lines in FIG. 7).

(7) Mounting of the Automatic Sheet Processing Device 1 to the Copying Apparatus 100 (FIG. 1)

Mounting of the automatic sheet processing device 1 to the copying apparatus 100 which is the sheet outputting apparatus is done in the following manner. First, the ordinary discharge sheet tray outwardly projectedly mounted in the sheet output port portion 101 on the left end plate side of the copying apparatus 100 is removed. Then, the set screws 152 at the four corners which secure the left end plate 151 of the pedestal 150 on which the copying apparatus 100 is installed are once removed, and the set screws 152 are inserted into the slots 2*h* at the four corners of the lower half of the vertical back plate 2*a* of the chassis of the device 1, and the left end plate 151 of the pedestal and the lower half of the back plate 2*a* of the chassis of the device 1 are secured to the pedestal body. In this case, the screws 152 are fastened with the vertical position of the device 1 relative to the copying apparatus 100 adjusted by the utilization of the slots 2*h* so that the opening portion 2*g* formed in the vertical back plate 2*a* of the chassis of the device 1 faces the sheet output port 101 of the copying apparatus 100 and the sheet receiving port of the pair of upper and lower sheet guide plates 3 and 3 of the device 1 faces the sheet discharging pinch rollers 103 of the copying apparatus 100.

Although not shown, the device 1 is provided with a cable (signal line) for connecting the electric circuit of the device 1 to the electric circuit of the copying apparatus 100, and the device 1 and the apparatus 100 is electrically connected together by inserting the end plug of the cable into the plug socket of the copying apparatus. Thus, mounting of the device 1 to the copying apparatus 100 is completed.

(8) Operation a. Copying is started with the number of copies N per original and the number of necessary copies to be produced M set in the copying apparatus 100. By the operation of the copying apparatus, copy sheets for the first original are output one after another from the sheet output port 101 of the copying apparatus 100. The output sheets P pass through the gap path between the upper and lower guide plates 3 and 3 of the device 1, are held by the nip of the sheet discharging pinch rollers 4 and 5, and are discharged by these pinch rollers into the tray 6 held in the first posture.

In the case of the present example, it is to be understood that the discharge of sheets from the copying apparatus 100 into the tray 6 is effected on the basis of the one side edge standard conveyance (sheet right side edge standard conveyance) with the broken line R—R (FIG. 11) near the right side edge of the tray as the standard line, irrespective of the size of the sheets.

b. A sheet P which has begun to be fed out toward the tray 6 by the pinch rollers 4 and 5, when fed out by an amount corresponding to a certain length, has its fed-out portion curved downwardly as indicated by solid line in FIG. 3 due to the gravity thereof against the rigidity thereof, and since the tray 6 is rightwardly downwardly inclined, the left corner $P_1$ of the leading end edge of the downwardly curved sheet portion comes into contact with the surface of the tray 6 at first (or, in the case of the second and subsequent sheets, comes into contact with the upper surface of the sheet already discharged into the tray). The then angle of entry $\theta$ of the sheet into the surface of the tray 4 is an acute angle.

c. Then, with the subsequent feeding-out of the sheet P toward the tray 6 by the pinch rollers 4 and 5, the leading end edge of the sheet smoothly slides up along the forwardly upwardly inclined surface of the tray 6 toward the fore end of the tray by the sheet feeding force and thus, feeding of the sheet P into the tray progresses.

d. When the trailing end edge of the sheet P has passed through the nip of the pinch rollers 4 and 5, the sheet P as a whole is fully discharged into the tray 6 (solid line in FIG. 11).

e. The sheet P discharged into the tray 6 then naturally slides down along the composite inclined surface of forwardly upward inclination or rearwardly downward inclination and rightwardly downward inclination in the direction A (FIG. 11) toward the right corner of the rear end of the tray 6 due to the gravity thereof.

f. In the case of the present example, in the sliding-down process of the sheet P in the direction A, the right side edge $P_R$ of the sheet P first strikes against the inner surface of the second sheet aligning ruler plate 8 and is position-controlled thereby (the state indicated by dots-and-dash line P″ in FIG. 11).

g. Then, the sheet P″ slide down along the second ruler plate 8 in the direction B toward the first ruler plate 7, and the trailing end edge $P_B$ of the sheet strikes against the inner surface of the first ruler plate 7 and is position-controlled thereby (the state indicated by dots-and-dash line P‴ in FIG. 11).

h. That is, the sheet P discharged into the tray 6 is finally received in the tray 6 with its right side edge $P_R$ and trailing end edge $P_B$ which are the two right-angled side edges on the sliding-down side being stopped and positioned by the right-angled first and second ruler plates 7 and 8 which are the aligning rulers. At this point of time, as described under item (6) above, the stapler mechanism is only once first-stage-depressed and returned to its initial position, whereby the keeping of the sheet discharged into and aligned in the tray 6 is executed by the downward movement and return of the underside of the stapler head portion 27 and the paper keeping member 40.

i. Thus, the second and subsequent output sheets also are successively discharged, aligned, kept and piled in the tray 6 in the same process as that described under items b–h above. The right corner of the trailing end edge of the bundle of sheets aligned in the tray 6 projects from the opening portion 22 between the first and second aligning ruler plates 7 and 8 toward the wide ledge *2f* of the chassis and is positioned on the staple needle receiving seat 39.

j. At a point of time whereat the last copy sheet for the first original is output and discharged into the tray 6 and becomes aligned in the tray, as described under item (6) above, the stapler mechanism is second-stage-depressed and returned to its initial position, whereby the bundle of sheets in the tray has the right corner of its trailing end edge struck by a staple needle and is staple-processed (bookbinding-processed) (FIG. 8C).

k. When the stapler mechanism returns to its standby condition, the motor M2 of the tray rocking mechanism 9 is driven for forward revolution by about 90° on the basis of that signal and the cam 18 assumes its upwardly rotated posture. Thus, the tray 6 is changed over from the first posture indicated by solid line in FIG. 5 to the second posture indicated by dots-and-dash line in FIG. 5 which is greater in the degree of rightward inclination than the first posture and a gap opening is created between the right side edge of the tray 6 and the lower edge of the second ruler plate 8, and the bundle of bookbound copy sheets in the tray slides down rightwardly along the rightwardly inclined surface of the tray from the gap opening and is automatically discharged and received into receiving container (stacker) 43 disposed on the sliding-down side, with the stapled side of the bundle as the leading end. By causing the stapled bundle of sheets to be discharged from the tray 6 onto the stacker 43 with the stapled side thereof as the leading end, so called loosening of the sheets can be prevented.

l. After the lapse of a predetermined timer time (usually of the order of one second) required for the bundle of bookbound sheets in the tray to be completely discharged out of the tray after the tray 6 has been changed over to the second posture, or after it has been detected by a sensor (not shown) disposed at the entrance of the stacker 43 that the bundle of sheets has been discharged and received into the stacker, the motor M2 is driven for reverse revolution by about 90° and the tray 6 is again changed over to the first posture.

m. Then, copy sheets for the second original are output one after another from the copying apparatus 100 to the device 1, and automatic alignment, automatic bookbinding and automatic discharging of the copy sheets for the second original are effected in the same manner as described above. Thus, finally, a bundle of M bound copy sheets is automatically adjusted by the repetition cycle mentioned under items b–m above and is received into the stacker 43.

Figure 13:
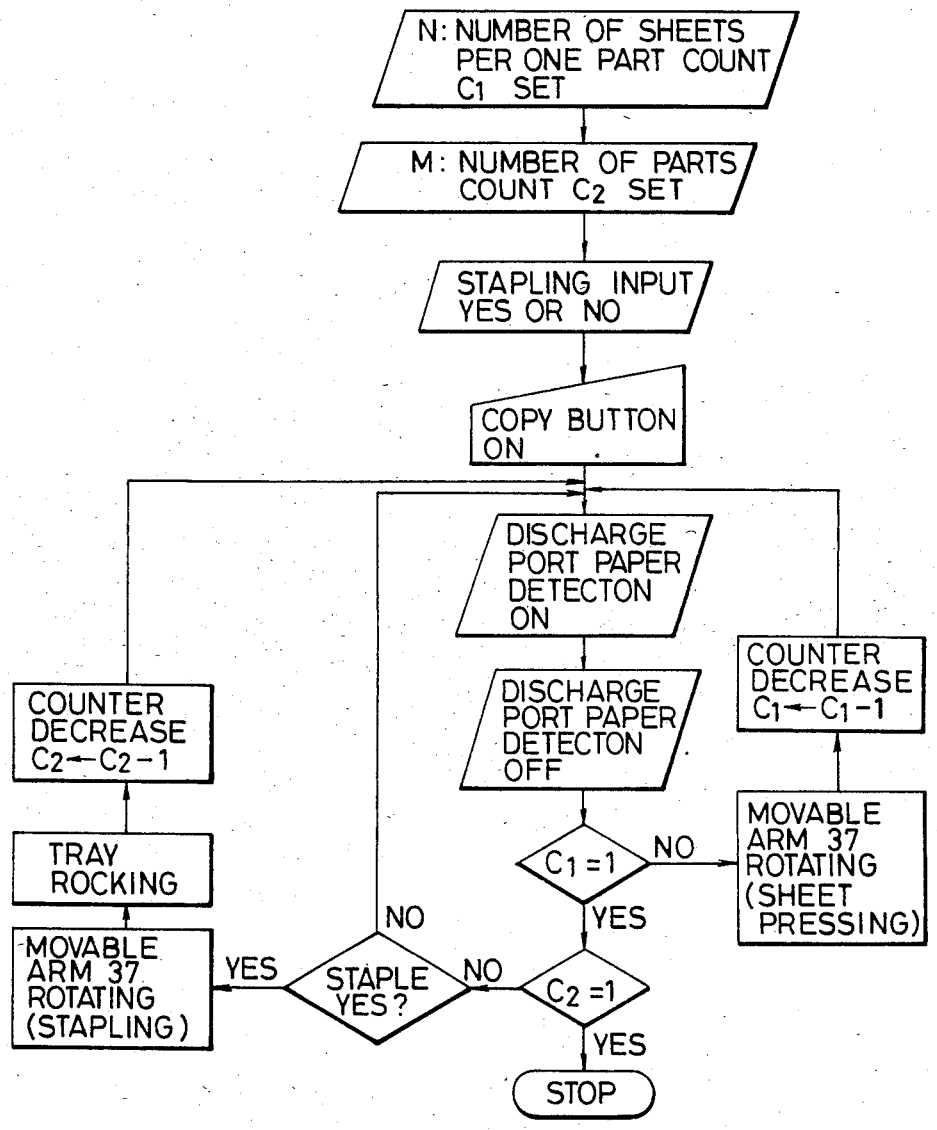
FIG. 13 is a flow chart of the operation of the device according to the first embodiment.

FIG. 13 shows the flow chart of the above-described control sequence.

Other embodiments or modifications of the present invention will be explained below.

Figure 14:
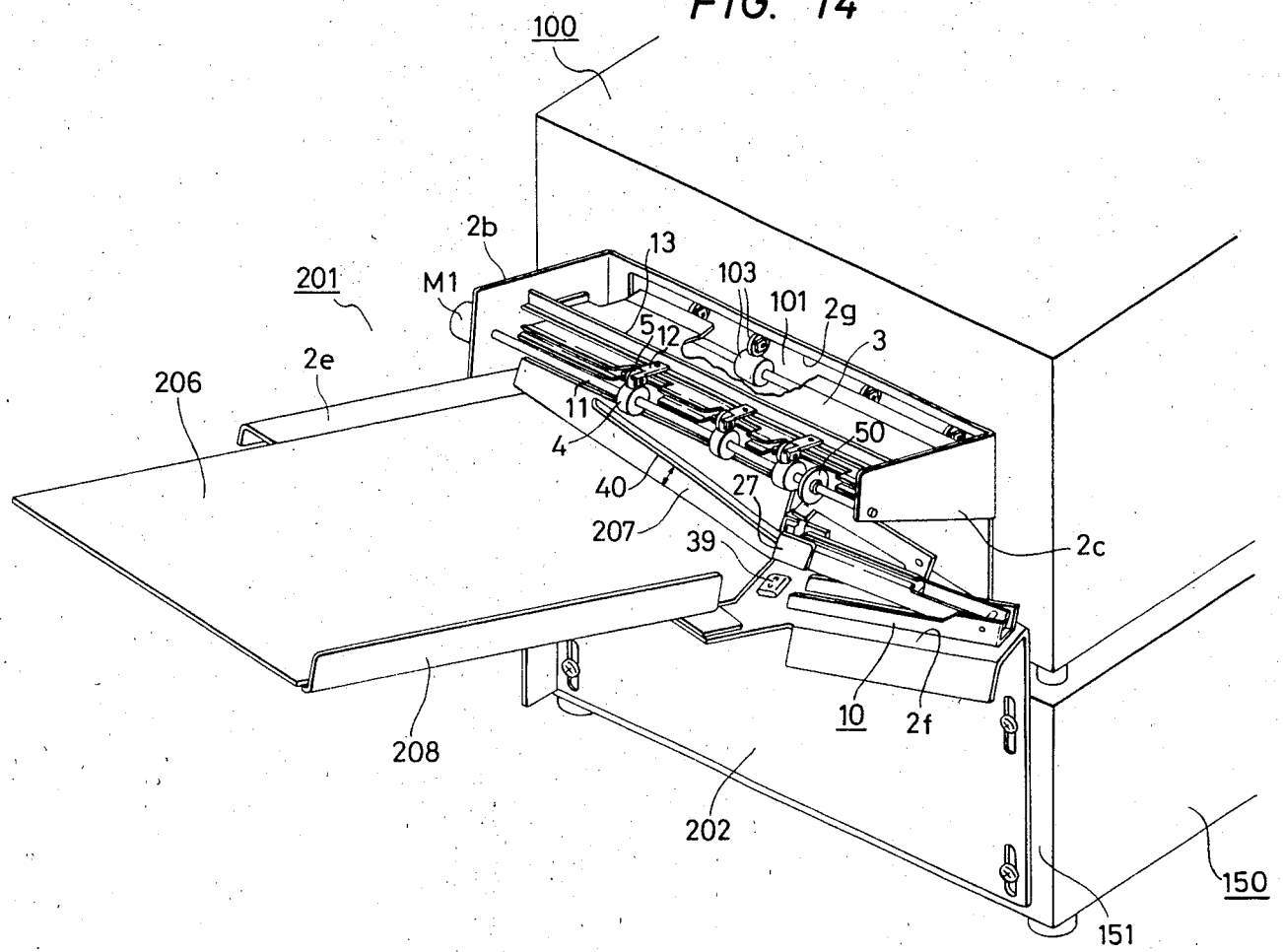
FIG. 14 is a perspective view of a second embodiment of the automatic sheet processing device according to the present invention as mounted to the sheet output port portion of a sheet outputting apparatus.
Figure 15:
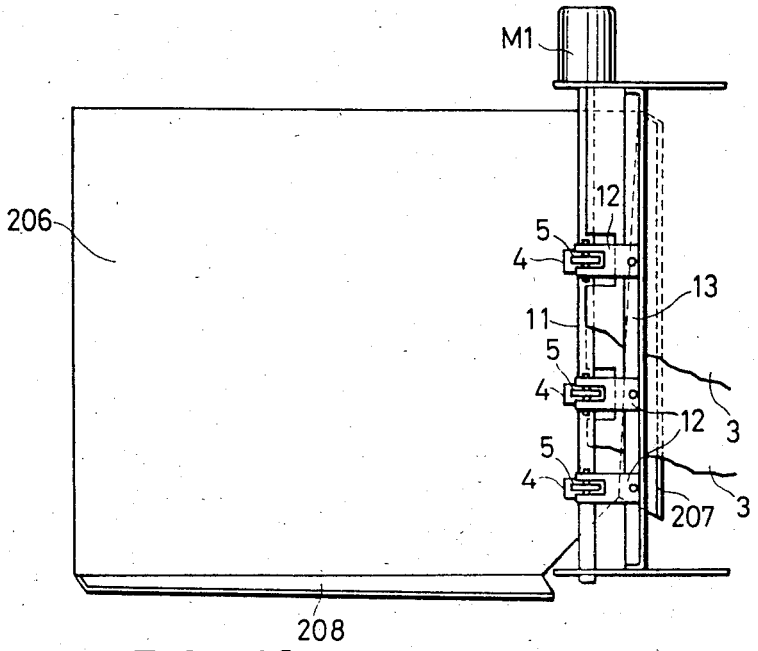
FIG. 15 is a plan view of the sheet collecting tray of FIG. 14 according to the second embodiment.
Figure 16:
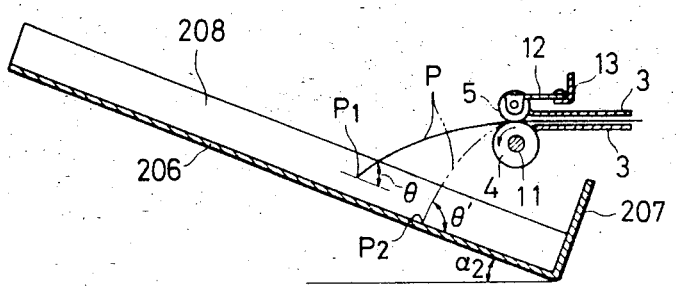
FIG. 16 is a longitudinal cross-sectional view of the same tray.
Figure 17:
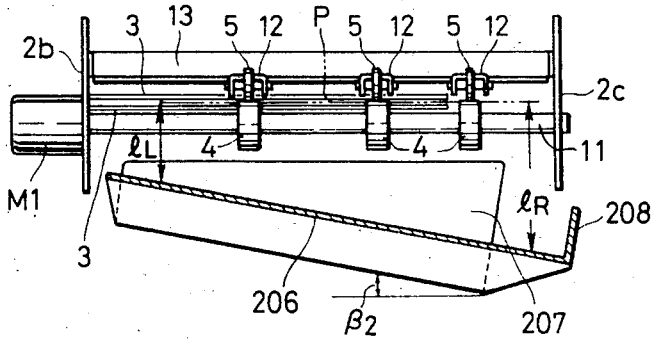
FIG. 17 is a transverse cross-sectional view of the same tray.

FIG. 14 illustrates a second embodiment of the present invention. Members similar to those described in the first embodiment are given similar reference numerals and need not be described again.

The second embodiment is principally different from the first embodiment in construction of the sheet correcting tray 206. Such a sheet correcting tray 206 itself is conventional as mentioned above, and will be briefly explained below referring to FIGS. 14 to 17.

In the case of the present example, the tray 206 is of the forwardly upwardly inclined type and is disposed in a posture in which the rear end edge of the tray is positioned below the pinch rollers 4 and 5 which are the sheet discharge port portion and is inclined at an angle $\alpha_2$ (FIG. 16) forwardly upwardly of the sheet discharge port portion and is inclined at an angle $\beta_2$ (FIG. 17) rightwardly downwardly with respect to the widthwise direction of the tray as viewed from the fore end edge of the tray. The angle $\alpha_2$ of forwardly upward inclination and the angle $\beta_2$ of lateral inclination are set, for example, to the ranges of 23°–26° and 6°–10°, respectively.

Reference numerals 207 and 208 designate two right-angled side plates as sheet alignment rulers constructed by bending the rear end edge portion of the tray 206 and the right side edge portion of the tray 206 upwardly at a right angle with respect to the plate of the tray.

Thus, the output sheet P from the sheet outputting apparatus passes through the gap path between the upper and lower guide plates 3 and 3 and is nipped by the nip of the sheet discharging pinch rollers 4 and 5 and discharged into the tray 206.

The present embodiment does not have the tray rocking mechanism and the roller 50 as provided for the first embodiment. Therefore, the tray 206 is constructed integrally with sheet alignment rulers 207, 208.

The stapler mechanism 10 as explained above is also provided for the automatic sheet processing device 201 of the second embodiment. The stapled sheets will be taken away from the tray 206 by hand. Since the other construction is as similar as that of the first embodiment, further explanation of the other is omitted.

Figure 18:
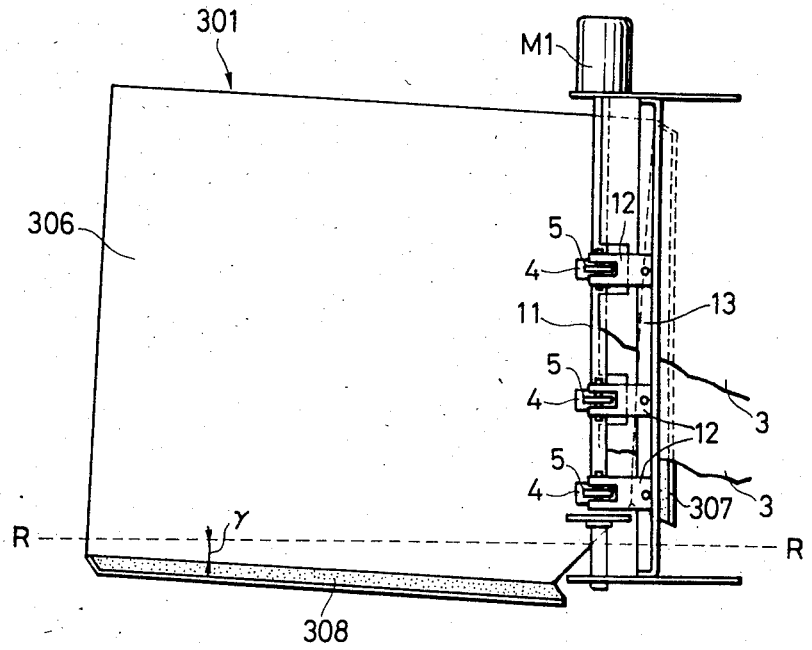
FIG. 18 is a plan view of the sheet collecting tray according to a third embodiment of the present invention.
Figure 19:
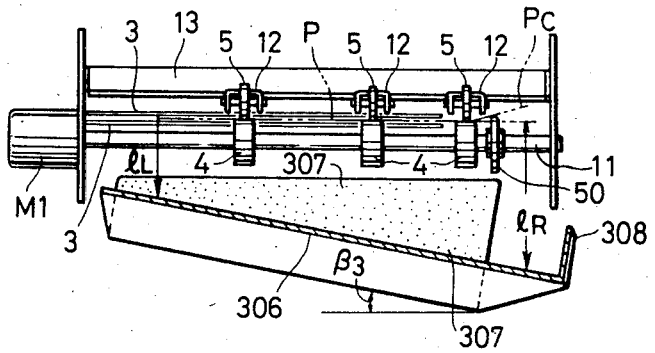
FIG. 19 is a transverse cross-sectional view of the same tray.
Figure 20:
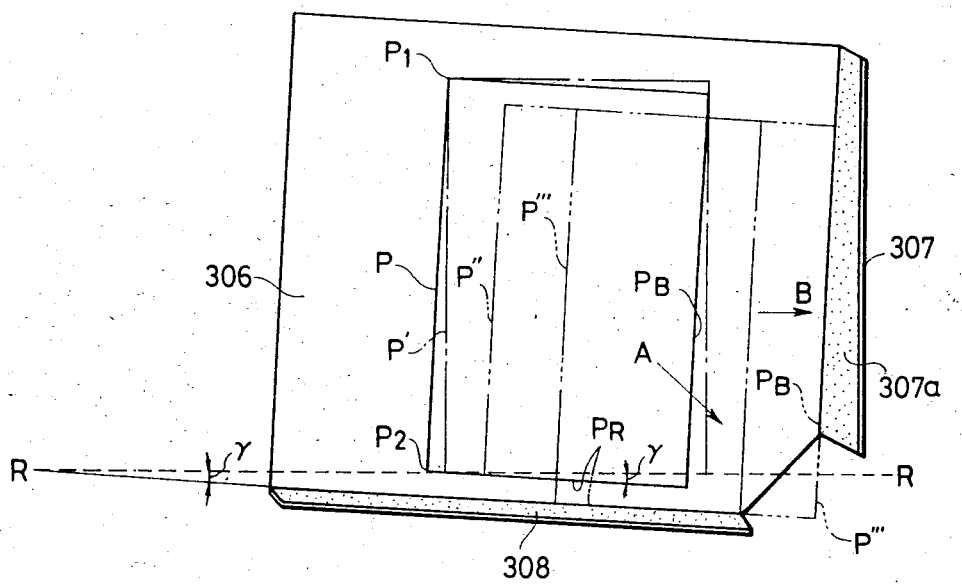
FIG. 20 illustrates the process of alignment of sheets in the tray of the third embodiment.

FIGS. 18 to 20 illustrate a third embodiment of the present invention. Members similar to the first and the second embodiments are given similar numerals, and the explanation thereof is omitted.

There will be described only different points in construction from the first and the second embodiments.

In the present embodiment, as shown in FIGS. 8 and 20, the side plate 308 for the alignment ruler on the right side of the tray for aligning the right side edge $P_R$ of the sheet discharged into the tray is disposed at an angle $\gamma$ with respect to the direction of sheet conveyance by the sheet discharging pinch rollers 4 and 5, i.e., the sheet one side conveyance standard line R—R, and the other side plate 307 is disposed perpendicularly to the side plate 308.

That is, the sheet P fed out from the sheet discharge port into the tray 306 is conveyed with its right side edge $P_R$ substantially coincident with the sheet one side conveyance standard line R—R until the trailing end edge $P_B$ of the sheet finishes passing between the sheet discharging pinch rollers 4 and 5 (the state indicated by dot-and-dash line P′ in FIG. 18). However, when the trailing end edge $P_B$ of the sheet has finished passing between the pinch rollers 4 and 5 and falls onto the tray 306, the sheet falls onto the tray while rotating about the left corner of the leading end edge of the sheet which is already in contact with the surface of the tray because the tray 306 is inclined forwardly upwardly by an angle $\alpha_3$ and rightwardly downwardly by an angle $\beta_3$, whereby the posture of the sheet P in the tray 306 when it has finished falling onto the tray is as indicated by solid line in FIG. 18 wherein the right side edge $P_R$ of the sheet is inclined by an angle $\gamma$ with respect to the sheet one side conveyance standard line R—R. The angle $\gamma$ actually was about 5° when the angle of inclination $\alpha_3$ of the tray 306 was $\alpha_3=23°-26°$ and the angle $\beta_3$was $\beta_3=6°-10°$ and the distance over which the right corner of the trailing end edge of the sheet fell from the sheet discharge port was 75 mm. Therefore, in the present embodiment, with regard to the angle $\gamma$, the side plate 308 for the alignment ruler on the right side of the tray was disposed while being inclined with respect to the sheet one side conveyance standard line R—R so that the right side edge $P_R$ of the sheet was in contact with the side plate 308 in parallelism thereto over the full length thereof. Also, as regards the trailing end edge $P_B$ of the sheet, the sheet P″ slides down in the direction B along the side plate 308 after the right side edge $P_R$ of the sheet has been positionally controlled by the side plate 308, whereby the trailing end edge $P_B$ contacts the side plate 307 in parallelism thereto.

In order to prevent the bound phenomenon of the sheet caused by the shock when the sheet discharged into the inclined tray slides down along the slope of the tray and strikes against the side plate of an alignment ruler and thereby ensure the alignment of the sheet, two right-angled side plates 307 and 308 for the sheet alignment ruler have a shock absorbing material attached to the inner surface of at least one thereof or the side plates themselves are formed of a shock absorbing material.

In the present embodiment, as previously described, the sheet P discharged into the tray 306 and then sliding down along the slope of the tray has its right side edge $P_R$ first striking against the side plate 308 for the alignment ruler on the right side of the tray and subjected to a positional control (the state indicated by dots-and-dash line P″ in FIG. 18), and then that sheet slides down along the side plate 308 in the direction B toward the rear side plate 307 of the tray which is the other alignment ruler and the rear side edge $P_B$ of the sheet strikes against the side plate 307 and is subjected to positional control and thereby aligned (the state indicated by dots-and-dash line P‴ in FIG. 18) and therefore, the right side plate 308 of the tray is made into a surface of a material having a small friction coefficient such as a metal surface or a resin surface and the inner surface of the rear side plate 307 of the tray has attached thereto a shock absorbing material 307*a* such as Urethane Foam Sheet Seagull Suede (trade name) so as to alleviate the shock during the final striking.

Where discharge of sheets of various sizes into the tray 306 is effected on the basis of one side standard conveyance which the right or left side edge of the sheet as the standard, the inclination of the tray 306 with respect to the lateral direction is made such that the sheet conveyance standard line side is lower. In the case of the present embodiment, the inclination of the tray 306 with respect to the lateral direction is made such that the sheet conveyance standard line R—R side is lower. By doing so, even if the sizes of the sheets discharged into the tray 306 variously differ, the distance between the two right-angled side edges $P_R$, $P_B$ of the sheet immediately after it has been discharged into the tray 306 and the two right-angled side plates 308, 307 as the sheet alignment rulers disposed on the sheet sliding down side of the tray is always substantially constant, and the sliding-down route and manner of the sheet after it has been discharged into the tray 306 and the time required for completion of alignment are the same for any of sheets of various sizes and thus, stable alignment of sheets can be accomplished.

The angle formed between the two side plates 307 and 308 as the sheet alignment rulers is not set exactly to 90° but is set to a slightly smaller angle, e.g., the order of 88°-89°, and by doing so, the possibility of the trailing end edge $P_B$ of the sheet P becoming deviated after striking against the side plate 307 is eliminated (the action of the sheet fitting between the ruler plates 307 and 308) and more excellent mutual alignment of sheets can be obtained.

The automatic sheet processing device 301 is also provided with the stapler mechanism (not shown). The sheets stacked on the tray 306 are stapled by the stapler mechanism and taken away from the tray 306 by hand.

Figure 21:
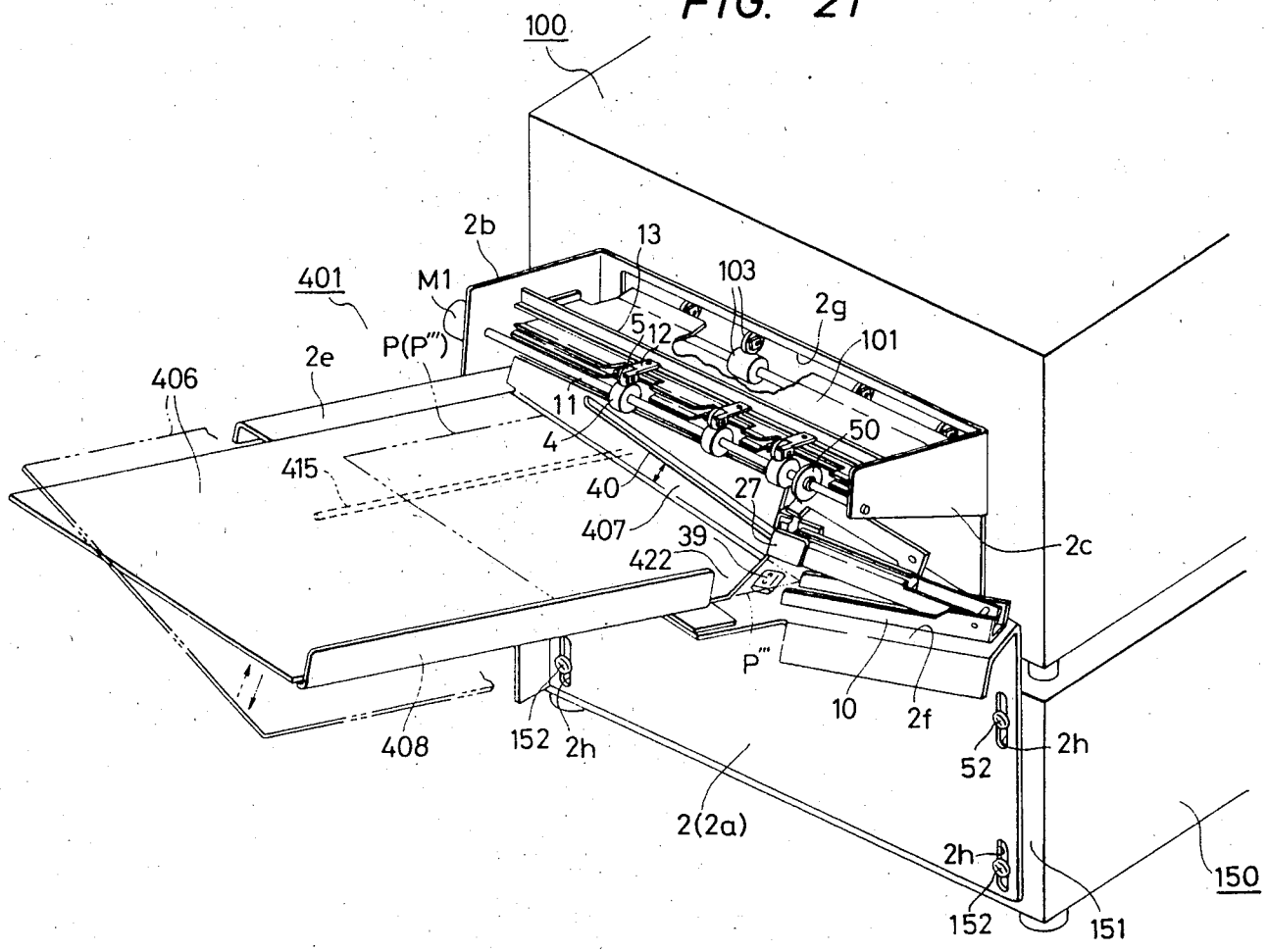
FIG. 21 is a perspective view of a fourth embodiment of the automatic sheet processing device according to the present invention as mounted to the sheet output port portion of a sheet outputting apparatus.
Figure 22:
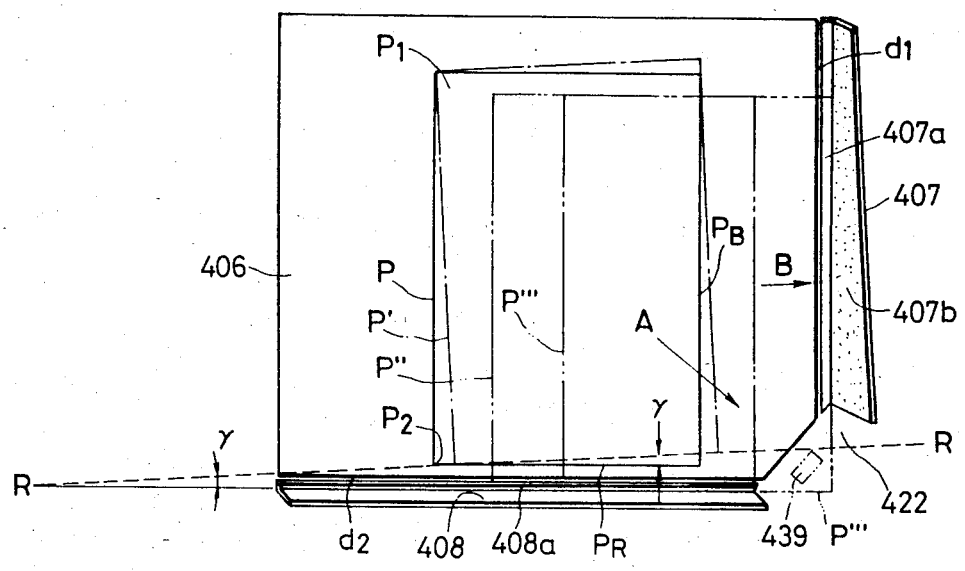
FIG. 22 is a plan view of the sheet collecting tray according to the fourth embodiment.

FIGS. 21 and 22 illustrate a fourth embodiment of the present invention in which a tray 406 is inclined in three dimensions and rockably supported.

In the present embodiment, as shown in FIG. 22, the second aligning ruler plate 408 for aligning the right side edge $P_R$ of the discharged sheet in the tray is disposed at an angle $\gamma$ with respect to the direction of sheet conveyance by the sheet discharging pinch rollers 4 and 5, i.e., the sheet one side conveyance standard line R—R, and the first aligning ruler plate 407 is disposed at a right angle with respect to the second ruler plate 408.

That is, the sheet P fed out from the sheet discharge port portion into the tray 406 is conveyed with its right side edge $P_R$ being substantially coincident with the sheet one side conveyance standard line R—R until the trailing end edge $P_B$ of the sheet passes between the sheet discharging pinch rollers 4 and 5 (the state indicated by dot-and-dash line P′ in FIG. 22). However, when the trailing end edge $P_B$ of the sheet has passed between the pinch rollers 4 and 5 and falls onto the tray 406, the sheet falls onto the tray while rotating about the left corner $P_1$ of the leading end edge of the sheet which is already in contact with the surface of the tray because the tray 406 is forwardly upwardly inclined at an angle $\alpha_4$ and rightwardly downwardly inclined at an angle $\beta_4$, whereby the posture of the sheet P in the tray at a point of time whereat the sheet has fallen into the tray 406 is such that, as indicated by solid line in FIG.

22, the right side edge $P_R$ of the sheet is inclined at an angle $\gamma$ with respect to the sheet one side conveyance standard line R—R. Actually, the angle $\gamma$ was about 5° when the angle of inclination $\alpha_4$ of the tray 406 was $\alpha_4=23°-26°$ and $\beta_4=6°-10°$ and the distance of falling of the right corner of the trailing end edge of the sheet from the sheet discharge port portion was 75 mm. So, in the present embodiment, with regard to the angle $\gamma$, the second aligning ruler plate 408 for aligning the right side edge $P_R$ of the sheet is pre-inclined with respect to the sheet one side conveyance standard line R—R so that the right side edge $P_R$ of the sheet is brought into contact with the second ruler plate 408 over the full length thereof in parallelism thereto. Also, with regard to the trailing end edge $P_B$ of the sheet, the sheet P″ slides down in the direction B along the second ruler plate 408 after the right side edge $P_R$ of the sheet has been position-controlled by the ruler plate 408, whereby the trailing end edge $P_B$ of the sheet contacts the first ruler plate 407 in parallelism thereto.

The automatic sheet processing device 401 of the fourth embodiment is also provided with the stapler mechanism 10 and a tray rocking mechanism 415 which are substantially same as those of the first embodiment.

Figure 23:
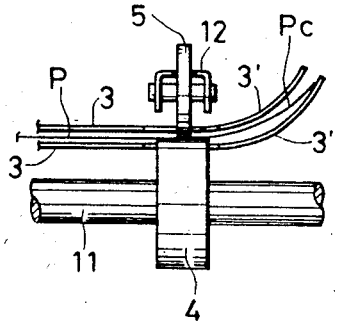
FIG. 23 shows an example in which a sheet guide plate is warped so as to warp sheets.

FIG. 23′ shows another embodiment of the mechanism for eliminating the aforementioned sheet reversal discharge trouble. In this embodiment, the right corners of the fore ends of the sheet guide plates 3 and 3 are upwardly curved to provide warps 3′ and 3′, and by these warps 3′ and 3′ of the guide plates, warp Pc can be imparted to the sheet as in the case of said roller 50.

In the case of the present embodiments the sheet aligning mechanism comprises the inclined trays, 6, 206, 306, 406, and the first and second sheet aligning ruler plates 7 and 8 disposed at right angles to each other, but alternatively, other aligning mechanism such as an aligning mechanism using vibration of the tray, an aligning mechanism using a driving belt or an aligning mechanism using a paddle may be adopted.

A bookbinding mechanism by starching may be provided instead of the bookbinding mechanism 10 by stapling. Further, any post-processing mechanism for a bundle of aligned sheets, such as a punching mechanism, may be provided.

The sheet guide plates 3 and 3 and sheet discharging pinch rollers 4 and 5 of the device 1 need not always be disposed where the sheet discharge port of the sheet outputting apparatus 100 can be positioned above the tray 6.

In the case of the first and fourth embodiments the first sheet aligning ruler plate 7, 407 may be formed integrally with the rear side edge of the tray 6, 406.

The cam 18 for rocking the tray 6 can be rotated, for example, by an electromagnetic solenoid-plunger or other suitable drive means.

The device 1 can also be made into a form of construction in which the necessary constituent members and means such as the sheet receiving tray 6, the sheet aligning means 7, 8 and the bookbinding means 10 are assembled in a predetermined positional relationship with the chassis having in itself a self-supporting property on the floor or the pedestal and having an adjustable height and the device 1 is disposed adjacent to the sheet output port 101 of the sheet outputting apparatus 100 with its height suitably adjusted so that the sheet receiving portion of the device is coincident with the sheet output port of the sheet outputting apparatus 100 and is used in combination with the sheet outputting apparatus.

Figure 24:
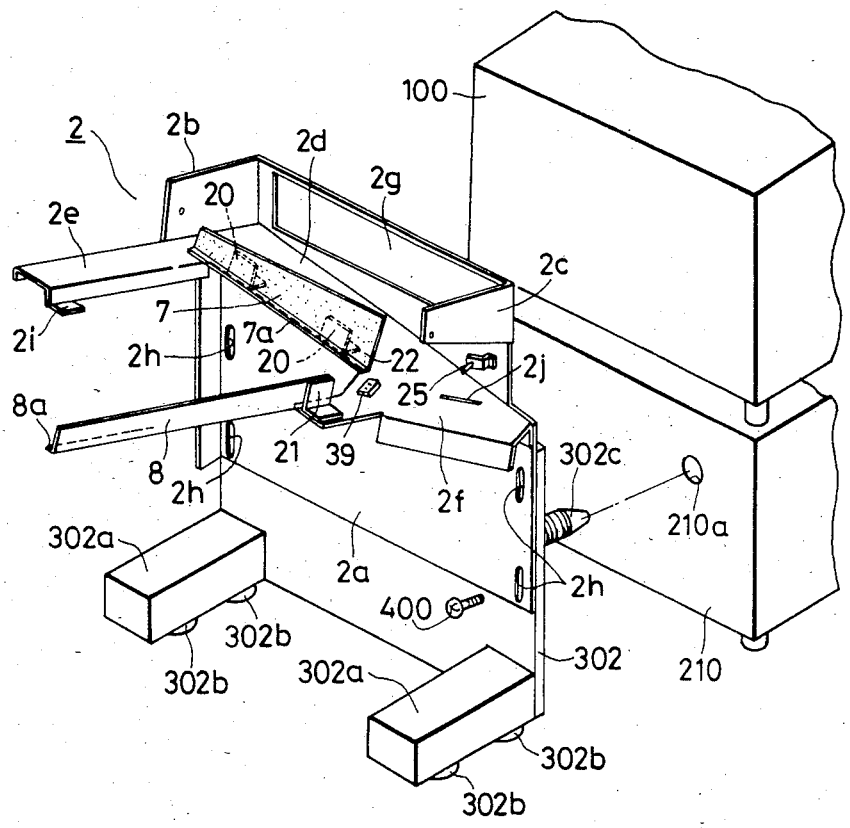
FIG. 24 is a perspective view of another embodiment of the chassis.

FIG. 24 is a perspective view of the chassis having a self-supporting property. The chassis 2 is adjustably assembled to a receiving plate 302. The receiving plate 302 is provided with a support member **302*a* and is movable by a roller 302*b*. This chassis 2 is provided with a guide pin 302*c* and may be positioned by the pin 302*c* being fitted into the guide hole 210*a* of the pedestal 210. Designated by 400 is a screw for fixing the chassis 2 to the receiving plate 302**.

I claim:

1. A sheet collecting tray device comprising:

a sheet collecting tray disposed in a posture inclined forwardly upwardly or forwardly downwardly and rightwardly downwardly or leftwardly downwardly with respect to a sheet discharge port portion for receiving sheets put out from a sheet outputting apparatus, said tray being rockably supported;

tray rocking means for selectively changing said tray to a first posture in which it is capable of receiving the output sheets from the sheet outputting apparatus and a second posture more steeply inclined than said first posture;

sheet aligning means for stopping the two side edges on the sliding-down side of the sheets successively discharged into said tray in said first posture and piled therein and aligning the sheets with one another; and binding means operating at a predetermined point of time after a predetermined number of sheets have been put out from the sheet outputting apparatus into said tray and binding a bundle of aligned sheets in said tray;

said tray being changed over to said second posture by said tray rocking means so that the bound bundle of sheets in said tray is slidingly discharged out of said tray.

2. An automatic sheet processing device according to claim 1, further comprising a member disposed in the sheet discharge port portion for said tray for warping that side of the sheet fed out from said sheet discharge port portion into said tray which corresponds to the rightwardly or leftwardly downwardly inclined side of said tray.

3. An automatic sheet processing device according to claim 2, wherein said member for warping is a roller rotatably fitted on a pinch roller driving shaft provided in the sheet discharge port portion.

4. An automatic sheet processing device according to claim 10, wherein said member for warping is a corner of the fore end of a sheet guide plate and is upwardly warped.

5. An automatic sheet processing device according to claim 1, wherein said sheet aligning means being inclined as viewed in the direction of discharge of the sheets so that the posture of the sheet in said inclined tray at a point of time whereat the entire sheet fed out from said sheet discharge port portion into said tray has been discharged into said tray and said sheet aligning means are substantially parallel to each other.

6. An automatic sheet processing device comprising:

a sheet collecting tray rockably supported for receiving sheets output from a sheet outputting apparatus;

tray rocking means for selectively changing over said tray to a first posture in which it is capable of receiving the output sheets from the sheet outputting apparatus and a second posture which is more steeply inclined than said first posture and in which it causes the bundle of sheets to be discharged out of said tray;

sheet aligning means for aligning the sheets successively discharged into and piled in said tray in said first posture;

binding means for binding the bundle of aligned sheets in said tray after a predetermined number of sheets has been output into said tray from the sheet outputting apparatus; and drive means for operating said tray rocking means on the basis of the operation completion signal of said binding means to change over said tray to said second posture.

7. An automatic sheet processing device according to claim 6, wherein at least one of said sheet aligning means being disposed discretely from said tray, the lower side edge of said sheet aligning means discrete from said tray being formed with an overhanging edge opposed to an end face of said tray and facing said tray, the upper surface of said overhanging edge being disposed so as to underlie the upper surface of said tray.

8. An automatic sheet processing device according to claim 6, wherein the discharge of the bound bundle of sheets from said tray is effected in such a manner that the bound side thereof faces downwardly.

9. An automatic sheet processing device according to claim 6, wherein said binding means is displaced to three positions i.e., a stand-by position in which it does not act on the sheets in said tray, a first stage rocked position in which it contacts and holds down the sheets in said tray but does not bind the bundle of sheets, and a second stage rocked position in which it binds the bundle of sheets.

10. An automatic sheet processing device according to claim 9, wherein said binding means is controlled so that each time a sheet is discharged into said tray, said binding means is displaced to said first stage rocked position to effect the operation of holding down the sheets in said tray by said binding means and said binding means is displaced to said second stage rocked position after the last one of a predetermined number of sheets has been discharged into said tray and aligned therein.

11. An automatic sheet processing device according to claim 9, further comprising a sheet keeping member supported and disposed on the side of said binding means wherein said binding means is disposed to three positions i.e., a stand-by position in which it does not act on the sheets in said tray, a first stage rocked position in which it operates said sheet keeping member to hold down the sheets in said tray but does not bind the bundle of sheets, and a second stage rocked position in which it binds the bundle of sheets.

12. An automatic sheet processing device according to claim 11, wherein said sheet keeping member is formed of a resilient material.

13. An automatic sheet processing device according to claim 11, wherein said sheet keeping member presses the sheets and urges the side surface of the sheets against said sheet aligning means.

14. An automatic sheet processing device according to claim 11, wherein said binding means is controlled so that each time a sheet is discharged into and aligned in said tray, said binding means is displaced to said first stage rocked position to effect the operation of holding down the sheets in said tray by said sheet keeping member and said binding means is displaced to said second stage rocked position after the last one of a predetermined number of sheets has been discharged into and aligned in said tray.

15. An automatic sheet processing device according to claim 6, further comprising shock absorbing means provided in the inner surface of at least one of said sheet aligning means.

16. An automatic sheet processing device according to claim 6, wherein the discharge of the sheets from said sheet discharge port portion into said tray is effected by one side standard conveyance with the right side edge or the left side edge of the sheet as the standard and said tray is inclined so that the sheet conveyance standard line side is at a lower level.

17. An automatic sheet processing device according to claim 6, wherein the angle forced by said sheet aligning means being set to an angle smaller than a right angle.

* * * * *

UNITED STATES PATENT AND TRADEMARK OFFICE

CERTIFICATE OF CORRECTION

PATENT NO. : 4,605,211

DATED : August 12, 1986

INVENTOR(S) : HIRAKU SONOBE

It is certified that error appears in the above-identified patent and that said Letters Patent is hereby corrected as shown below:

Column 3, line 28, delete "," after "processing";
line 31, change "are" to --or--;
line 44, change "sheet" to --sheets--.

Column 4, line 47, after "respectively" insert --,--.

Column 6, line 5, change "alinged" to --aligned--.

Column 7, line 11, after "formed" change "or" to --of--;
line 54, change "continuedly" to --continuously--.

Column 8, line 62, after "hereinafter" insert --be--.

Column 10, line 18, change "alinging" to --aligning--.

Column 12, line 64, change "as" to --an--;

Column 14, line 14, change "is" to --are--.

Column 15, line 9, change "slide" to --slides--.

Column 17, line 1, change "8" to --18--.

UNITED STATES PATENT AND TRADEMARK OFFICE

CERTIFICATE OF CORRECTION

PATENT NO. : 4,605,211

DATED : August 12, 1986

INVENTOR(S) : HIRAKU SONOBE

It is certified that error appears in the above-identified patent and that said Letters Patent is hereby corrected as shown below:

Column 18, line 9, change "which" to --with--.

Column 19, line 36, change "mechanism" to --mechanisms--.

Column 20, line 52 (Claim 4, line 2), change "10" to --2--;

line 56 (Claim 5, line 2), change "being" to —are--.

Signed and Sealed this

Sixth Day of January, 1987

*Attest:*

DONALD J. QUIGG

*Attesting Officer*

*Commissioner of Patents and Trademarks*